US010518567B2

(12) United States Patent
Ericson et al.

(10) Patent No.: US 10,518,567 B2
(45) Date of Patent: Dec. 31, 2019

(54) STAMPING TOOL WITH REMOVABLY ATTACHED COVER AFFIXED TO A BASE WITH A HINGING ASSEMBLY AND METHOD OF STAMPING

(71) Applicant: Stampin' Up! Inc., Riverton, UT (US)

(72) Inventors: John Ericson, Salt Lake City, UT (US); Jessica Gallagher, Sandy, UT (US); Tanner Smedley, Herriman, UT (US); Mike Vanderlinden, Holladay, UT (US); Kyle Hill, Farmington, UT (US)

(73) Assignee: STAMPIN' UP! INC., Riverton, UT (US)

( * ) Notice: Subject to any disclaimer, the term of this patent is extended or adjusted under 35 U.S.C. 154(b) by 0 days.

(21) Appl. No.: 15/806,955

(22) Filed: Nov. 8, 2017

(65) Prior Publication Data

US 2019/0135006 A1 May 9, 2019

(51) Int. Cl.
*B41K 3/04* (2006.01)
*B41K 3/46* (2006.01)
(Continued)

(52) U.S. Cl.
CPC ..... *B41K 3/04* (2013.01); *B41K 3/00* (2013.01); *B41K 3/02* (2013.01); *B41K 3/32* (2013.01);
(Continued)

(58) Field of Classification Search
CPC ... B41K 3/04; B41K 3/00; B41K 3/02; B41K 3/32; B41K 3/46; B41K 1/00; B41K 1/38;
(Continued)

(56) References Cited

U.S. PATENT DOCUMENTS 848,724 A 4/1907 Chandler
5,704,167 A 1/1998 Swinderman
(Continued)

FOREIGN PATENT DOCUMENTS

ES 2178931 B1 1/2003
WO WO-2019094005 A1 * 5/2019

*Primary Examiner* — Leslie J Evanisko
(74) *Attorney, Agent, or Firm* — Jones Waldo Holbrook & McDonough, PC; Brent T. Winder

(57) ABSTRACT

A stamping tool is provided including a base and a cover. The cover is removably affixed to the base through a hinging assembly. The base can include a first base hinge and a second base hinge substantially perpendicular to the first base hinge. The base hinges can be one or more hinge sections. The hinge sections can include a first wall and a second wall that can be biased to define a cavity that is accessible through a channel between the first wall and the second wall. Hinge sections can be separated by one or more receptacles. The cover can include one or more hinge bars corresponding to the hinge sections on the base. The hinge bars can have an unequal aspect ratio allowing for easy insertion and removal of the cover. The cover can also include one or more protrusions separating the hinge bars. These protrusions correspond to the receptacles on the base. A method of stamping an article is also included wherein the stamping tool is provided. The cover is placed in an open position relative to the base. A stamp is adhered to the bottom surface of the cover. The article to be stamped is placed on the top surface of the base. A quantity of ink is applied to the stamp and, as the cover is placed in a closed position, the stamp is brought into contact with the article thereby stamping the article with the ink.

20 Claims, 11 Drawing Sheets

(51) Int. Cl.

| | |
|---|---|
| ***E05D 7/10*** | (2006.01) |
| ***B41K 3/00*** | (2006.01) |
| ***B41K 3/02*** | (2006.01) |
| ***B41K 3/32*** | (2006.01) |

(52) U.S. Cl.
CPC ..... *B41K 3/46* (2013.01); *E05D 7/1072* (2013.01); *E05Y 2900/60* (2013.01)

(58) Field of Classification Search
CPC ..... B41K 1/54; B44B 5/02; Y10T 16/53613; Y10T 16/53615; Y10T 16/5362; Y10T 16/53625; E05D 7/10; E05D 7/1066; E05D 7/1061; E05D 7/1072; E01D 1/00
USPC ..... 101/327, 333; 16/267, 268, 269; D19/108, 113
See application file for complete search history.

(56) References Cited

U.S. PATENT DOCUMENTS

| | | | | |
|---|---|---|---|---|
| 6,065,251 | A * | 5/2000 | Kindrick ..... | A47K 3/001 108/157.13 |
| 6,199,482 | B1 | 3/2001 | Yasoshima | |
| 6,877,425 | B2 | 4/2005 | Lynton | |
| 7,246,556 | B1 | 7/2007 | Stoneberg et al. | |
| 2008/0202367 | A1 | 8/2008 | Biolcati Papa | |
| 2011/0011290 | A1 | 1/2011 | Rasmussen et al. | |
| 2012/0111597 | A1 * | 5/2012 | Korcz ..... | H02G 3/088 174/67 |
| 2016/0200126 | A1 | 7/2016 | Myska | |

* cited by examiner

STAMPING TOOL WITH REMOVABLY ATTACHED COVER AFFIXED TO A BASE WITH A HINGING ASSEMBLY AND METHOD OF STAMPING

BACKGROUND

In craft stamping, it is often challenging for a crafter to apply repeated stamp patterns with efficiency and precision. For example, traditional hand-stamping tools will often comprise a stamping section made of red rubber, acrylic, photopolymer, foam and numerous other materials known in the art. The stamp is affixed to a base—often made of wood—which then can include a handle or gripping section allowing a user to grasp the stamp, press it into an ink source, and then deposit the ink onto a surface to be stamped.

However, a stamper often wishes to make larger volumes of stamped surfaces (e.g. greeting cards or invitations). The method of individually hand-stamping each surface becomes tedious and also leads to inconsistent results simply as a function of human error.

Some stamping tools have been created to address this issue. However, the present invention is a marked improvement over prior art stamping apparatuses in that it features a hinging mechanism that allows for multi-directional stamping and quick substitution of covers from different orientations. It also allows for a wider assortment of surfaces to be stamped in terms of size and shape. In particular, because the present invention can function with only two hinge walls, it allows for a greater variety of length and width in the articles being stamped. Moreover, because the present invention does not require the cover to rest upon the hinge walls, it allows for greater variety in the depth of the workspace—meaning it can accommodate thinner stamps than can prior art stamping tools without the need for shimming.

The present invention in its various embodiments addresses all of the foregoing issues as well as others as will become apparent herein.

SUMMARY

The present invention is a stamping tool. In its various embodiments, the tool includes a base and a cover. The cover is removably affixed to the base through a hinging assembly. According to one embodiment, the base includes a first base hinge and a second base hinge substantially perpendicular to the first base hinge. The base hinges can include one or more hinge sections. The hinge sections in certain embodiments have a first wall and a second wall. The first wall and the second wall can be biased to define a cavity that is accessible through a channel between the first wall and the second wall. In certain embodiments, the hinge sections are separated by one or more receptacles. The cover can include one or more hinge bars corresponding to the hinge sections on the base. The hinge bars can have an unequal aspect ratio allowing for easy insertion and removal of the cover. The cover can also include one or more protrusions separating the hinge bars. These protrusions correspond to the receptacles on the base.

The configuration of the hinge bars can vary. In certain embodiments, the hinge bars are rectangular shaped in cross section. In some embodiments, the hinge bars are oval shaped in cross section. In yet other embodiments, the hinge bars are diamond-shaped in cross section. The protrusions can be rounded as can be the receptacles.

A method of stamping an article is also included. A stamping tool is provided. The stamping tool can include a base having a top surface, a first base hinge and a second base hinge substantially perpendicular to the first base hinge. The first and second base hinges can include one or more hinge sections. The stamping tool also includes a cover removably attachable to the base. The cover has a bottom surface relative to the base and can include one or more hinge bars corresponding to the one or more hinge sections on the base. The hinge bars can have an unequal aspect ratio. In operation, the cover is placed in an open position relative to the base. A stamp is adhered to the bottom surface of the cover. The article to be stamped is placed on the top surface of the base. A quantity of ink is applied to the stamp and, as the cover is placed in a closed position, the stamp is brought into contact with the article thereby stamping the article with the ink.

DESCRIPTION OF ILLUSTRATED EMBODIMENTS

Figure 1:
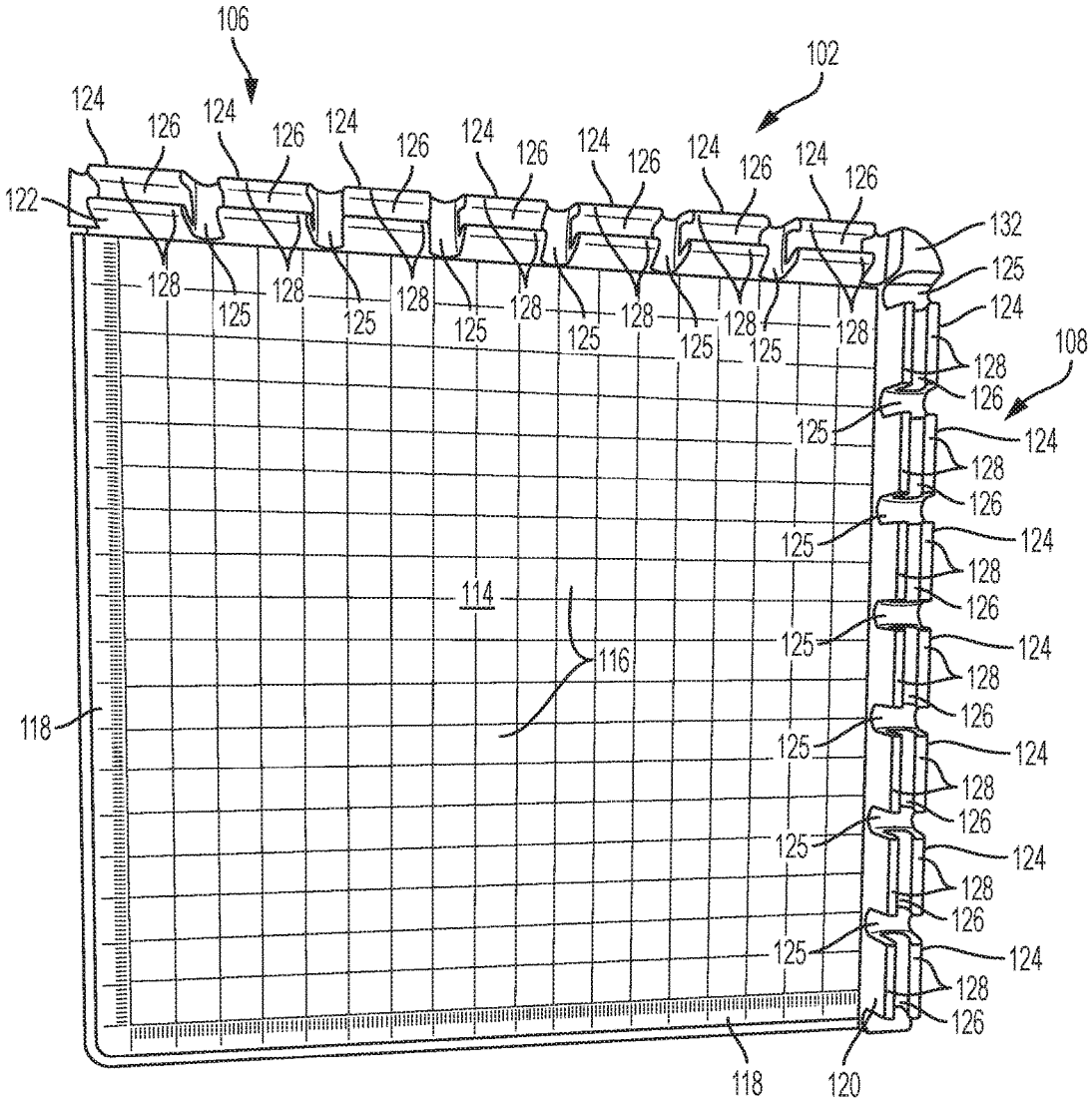
FIG. 1 depicts a craft stamping tool base according to one embodiment of the present invention.
Figure 5:
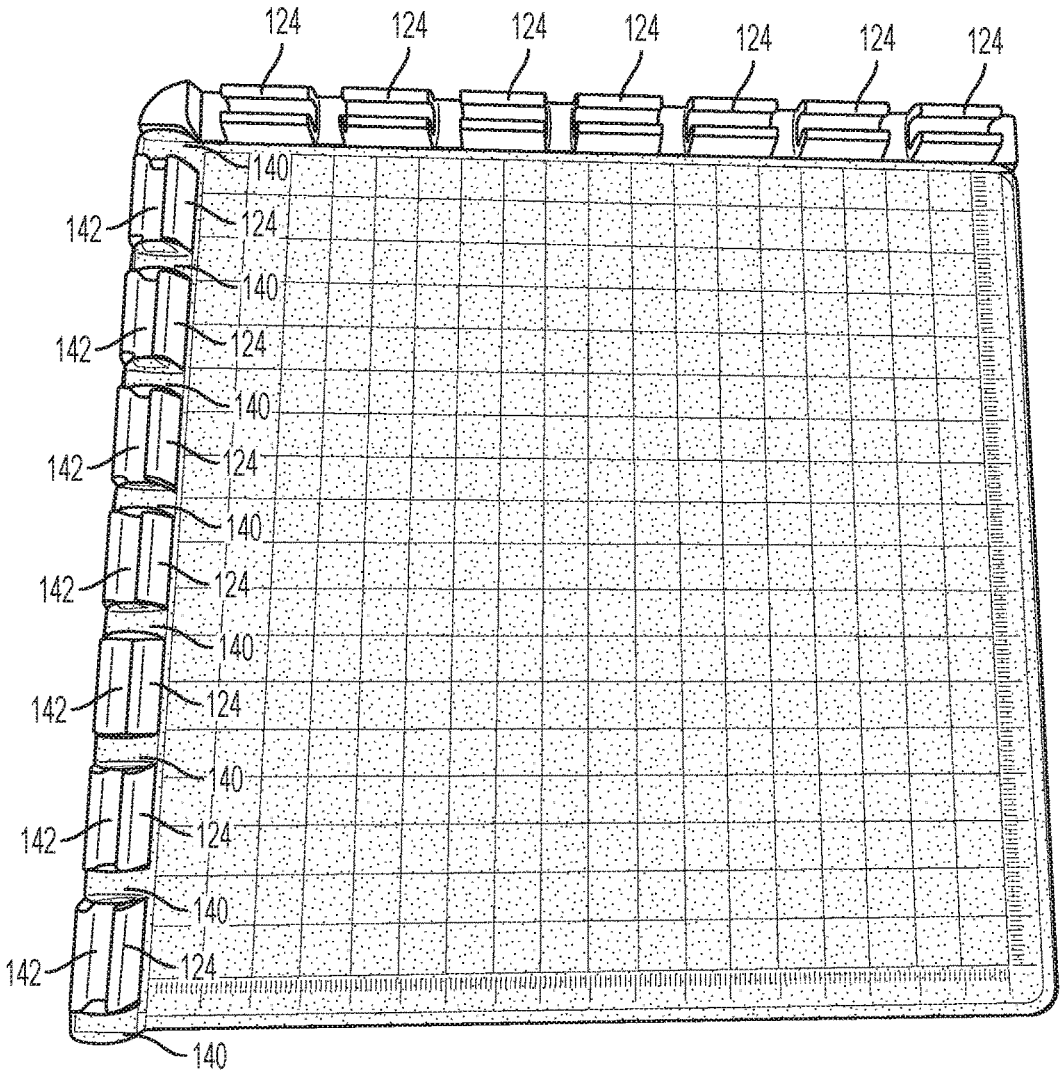
FIG. 5 depicts a craft stamping tool in a closed position according to one embodiment of the present invention.
Figure 6:
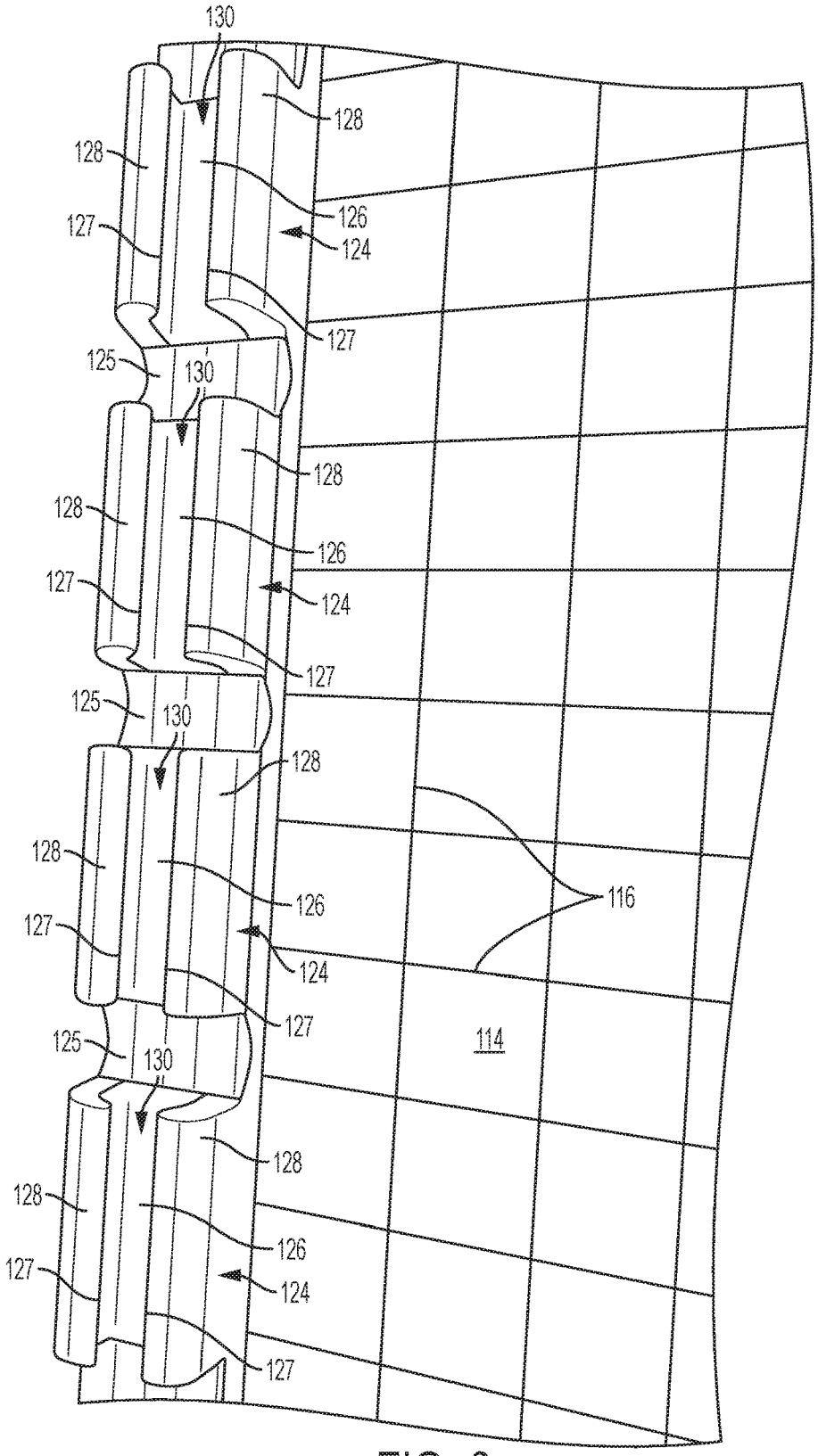
FIG. 6 depicts a plurality of base hinge sections according to one embodiment of the present invention.

Referring to FIGS. 1, 5-6, a craft stamping tool base 102 is shown according to one embodiment of the present invention. Base 102 includes a first hinge and a second hinge shown generally at 106, 108. It is noted that first hinge 106 will be referred to hereinafter as a "top" hinge and second hinge 108 as a "side" hinge. However, the use of the terms "top" and "side" are only in reference to the relative positions of the first and second base hinges 106, 108 and the orientation of the craft stamping tool 100 in the figures. No limitation is intended by the use of such spatial terms.

Base 102 also includes a top surface 114 and can include one or more grid lines 116 in relative horizontal and vertical orientation. Base 102 can also include one or more rulers 118. The top surface 114 is, generally speaking, the surface on which an article to be stamp is placed. Commonly stamped articles include but are not limited to paper, cardboard, wood, fabric, plastics, metals and glass.

Top hinge 106 and side hinge 108 are, in the presently illustrated embodiment, comprised of a plurality of hinge sections 124 to make up a top hinge wall 122 and a side hinge wall 120 against which the material being stamped or the insert pad 134 (FIG. 11) can abut. As noted above, hinge walls 120, 122 in the present embodiment are made up of a series of hinge sections 124 separated by receptacles 125. As discussed further below, the receptacles 125 can be spaces between hinge sections 124 that correspond to protrusions 140 on cover 104. Receptacles 125 as shown in the illustrated embodiment have rounded edges which allow easier rotation of the protrusions 140 as the cover 104 is opened and closed in operation. However, in other embodiments, non-rounded receptacles 125 may be advantageous.

While the present illustration depicts seven hinge sections 124 with corresponding receptacles 125, it is noted that in certain embodiments, fewer, larger hinge sections 124 may be desirable with correspondingly fewer receptacles 125. In yet other embodiments, one or both of the hinges 106, 108 may be a single piece with no hinge sections 124. In such embodiments, receptacles 125 could be limited to the ends of the respective walls 120, 122 or in other embodiments, there could be no receptacles 125 at all. However, the receptacles 125 are advantageous in that they provide low friction stability to the base and cover hinge assembly.

As is best seen in FIG. 6, each hinge section 124 can in certain embodiments comprise first and second slightly angled walls 128 that define a channel 126. In the illustrated embodiment, walls 128 include a slight bend 127 that create edges capable of engaging the hinge bars 142 in cavity 130 as discussed further below. The bends 127 are advantageous as they help prevent the cover 104 from coming disengaged when the product is in use and yet allow for easy removal of the cover 104 when desired. However, it is noted that the term "bends" is not intended to be limited to gradual, rounded sloping of the top edge of walls 128 but could include steeper sloping or angular changes of direction to create the engaging edges needed to hold the cover 104 in place when in use. The illustrated embodiment also can include a corner piece 132 between the side and top hinge 106, 108.

Figure 2:
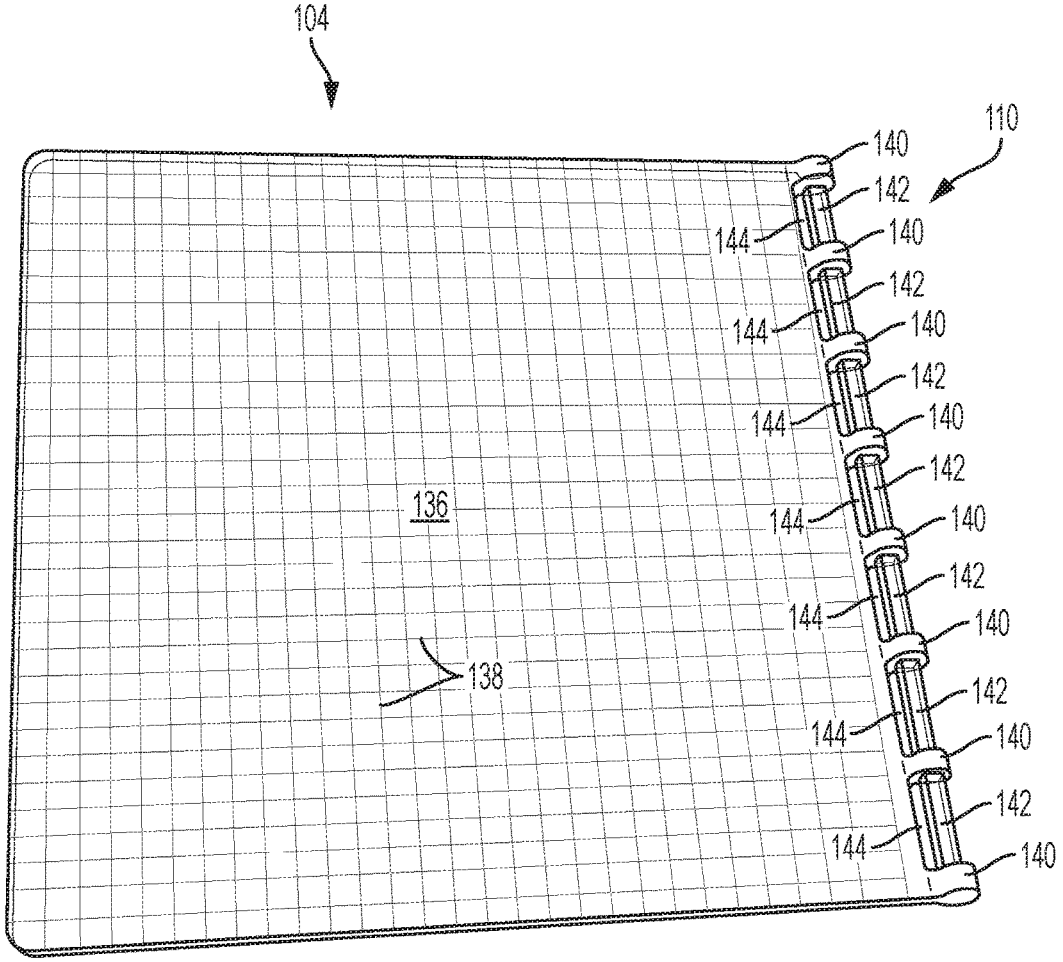
FIG. 2 depicts a craft stamping tool cover according to one embodiment of the present invention.
Figure 3:
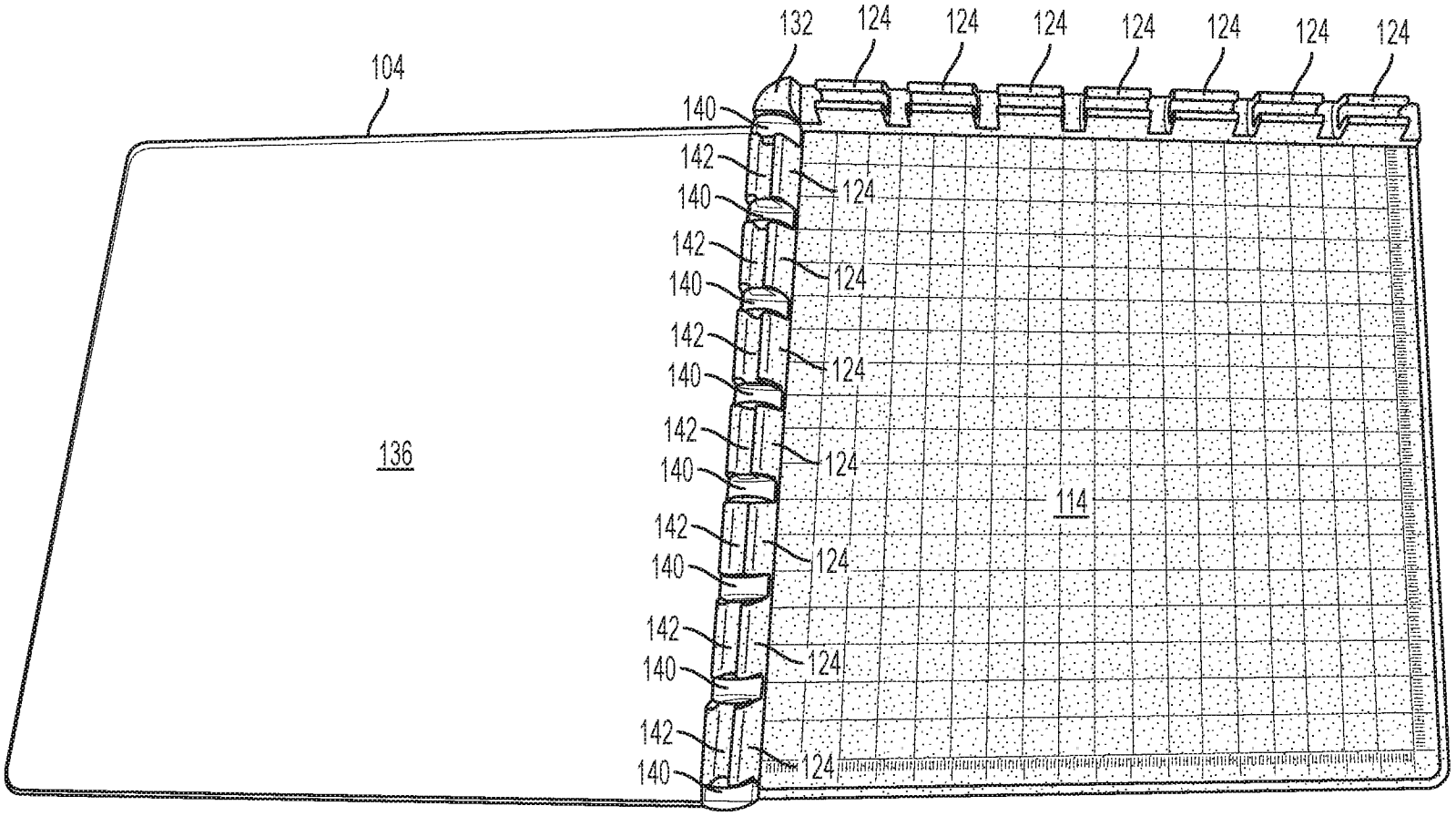
FIG. 3 depicts a craft stamping tool in an open position according to one embodiment of the present invention.
Figure 4:
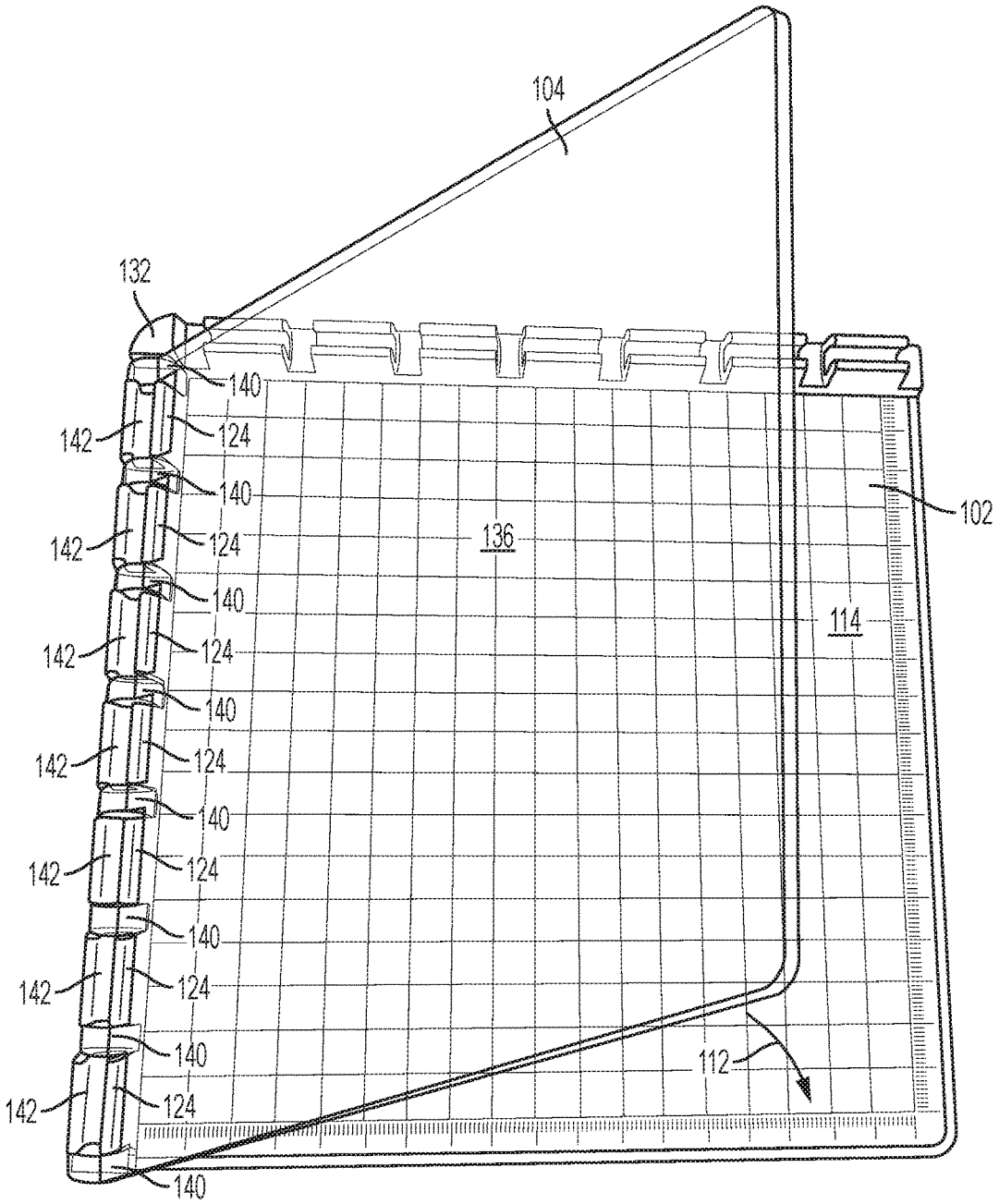
FIG. 4 depicts a craft stamping tool in a partially closed position according to one embodiment of the present invention.
Figure 7:
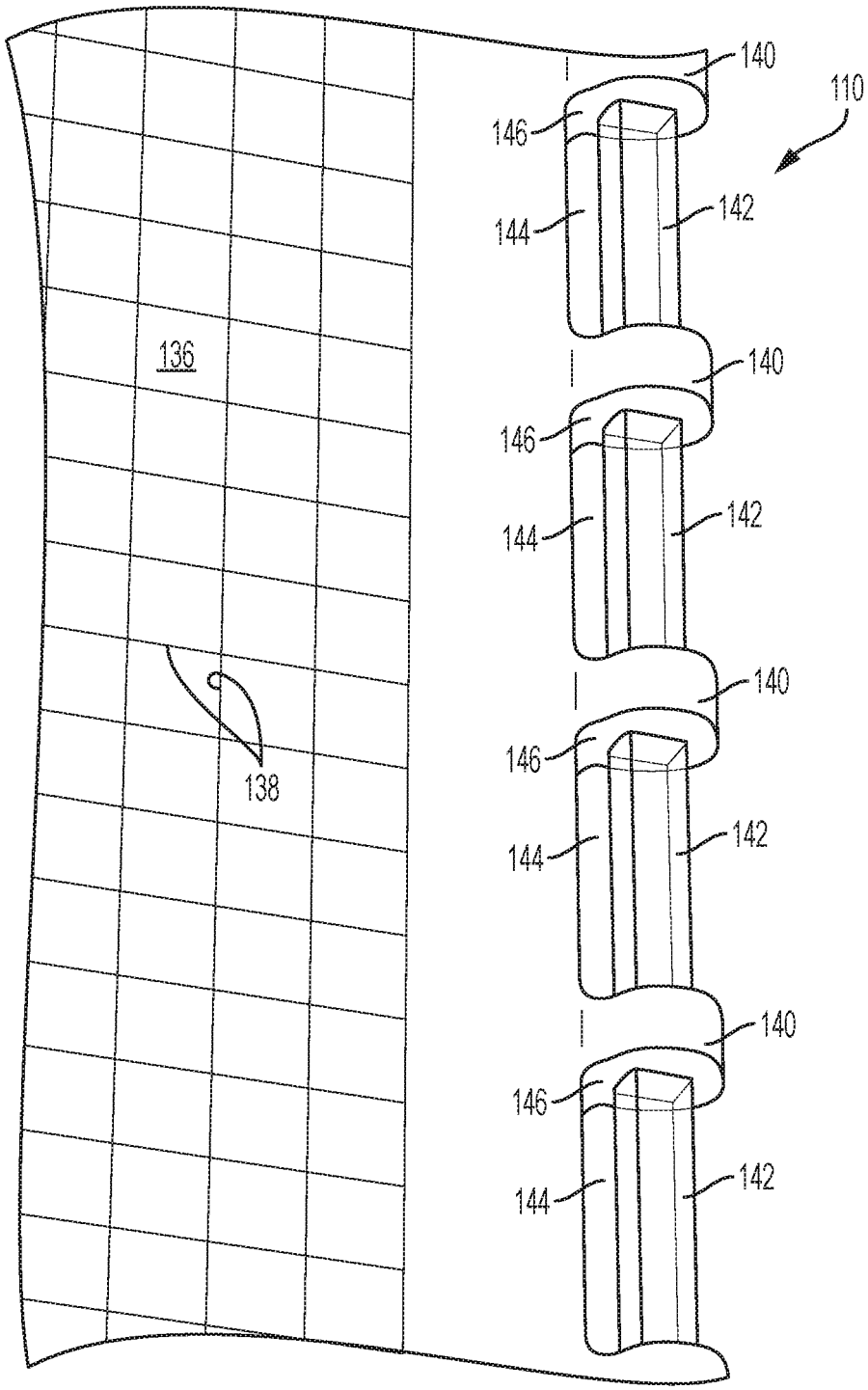
FIG. 7 depicts a portion of a cover hinge according to one embodiment of the present invention.

Referring now to FIGS. 2 and 7, a cover 104 for a craft stamping tool 100 is shown according to one embodiment of the present invention. Cover 104 includes a hinge shown generally at 110 and a main cover section shown generally at 136. Cover 104 can include one or more grid lines 138. In the illustrated embodiment, grid lines 138 are shown at relative horizontal and vertical orientations.

In the illustrated embodiment, hinge 110 comprises sections of a hinge bar 142 with space 144 underneath separated at regular intervals by protrusions 140. Though it is noted that, as with the base hinge sections 124, hinge bars 142 need not be at regular intervals but could vary in length, number and space to correspond to hinge sections 124 of base 102.

As noted above, protrusions 140 are in the illustrated embodiment rounded to correspond with receptacles 125 in base 102. Rounded protrusions 140 allow for hinge stability and smoother opening and closing of the cover 104 when in use but are not required. In this embodiment, protrusions 140 also include a small neck 146 such that edge of cover 104, neck 146 and hinge bar 142 define space 144. However, it is noted that in other embodiments, it may be desirable to exclude neck 146 with protrusion 140 directly on the edge of cover 104.

As seen in FIG. 7, hinge bars 142 can be substantially rectangular in cross section with substantially planar surfaces. This allows for easy insertion in and removal from channel 126. Notably, having hinge bars 142 with an unequal cross-sectional aspect ratio allows them to be easily inserted and removed. In particular, in the presently illustrated embodiment, when the cover 104 is at substantially a ninety-degree (90°) angle relative to the base 102, hinge bars 142 are narrower than channels 126 and can easily fit through them. However, once the cover 104 is rotated in either direction, the wider sides of hinge bars 142 face channels 126 and are not able to fit through. Thus, when in use, cover 104 is largely stable and un-removable.

Figure 8:
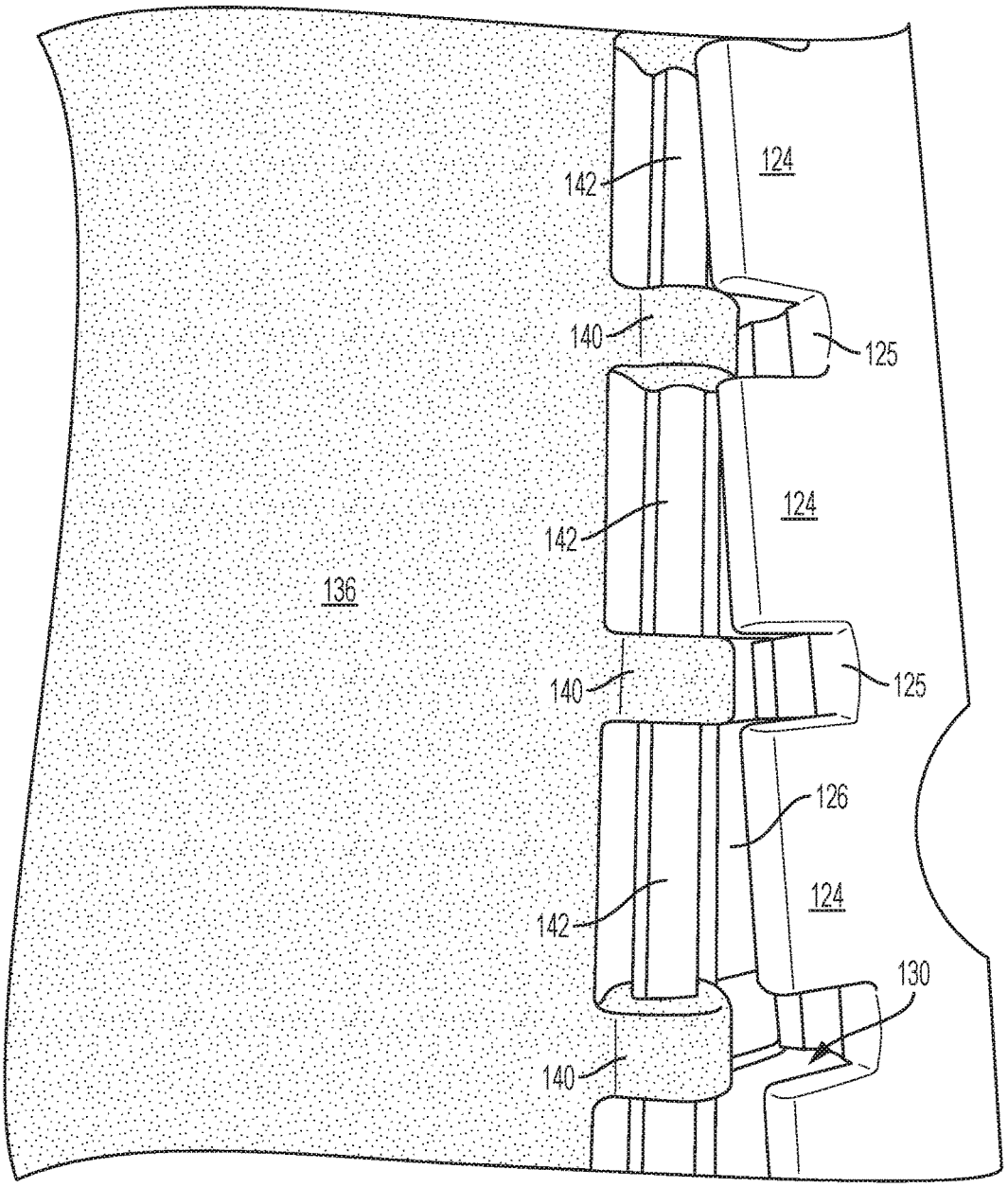
FIG. 8 depicts a partially assembled base and cover hinge mechanism according to one embodiment of the present invention.
Figure 9:
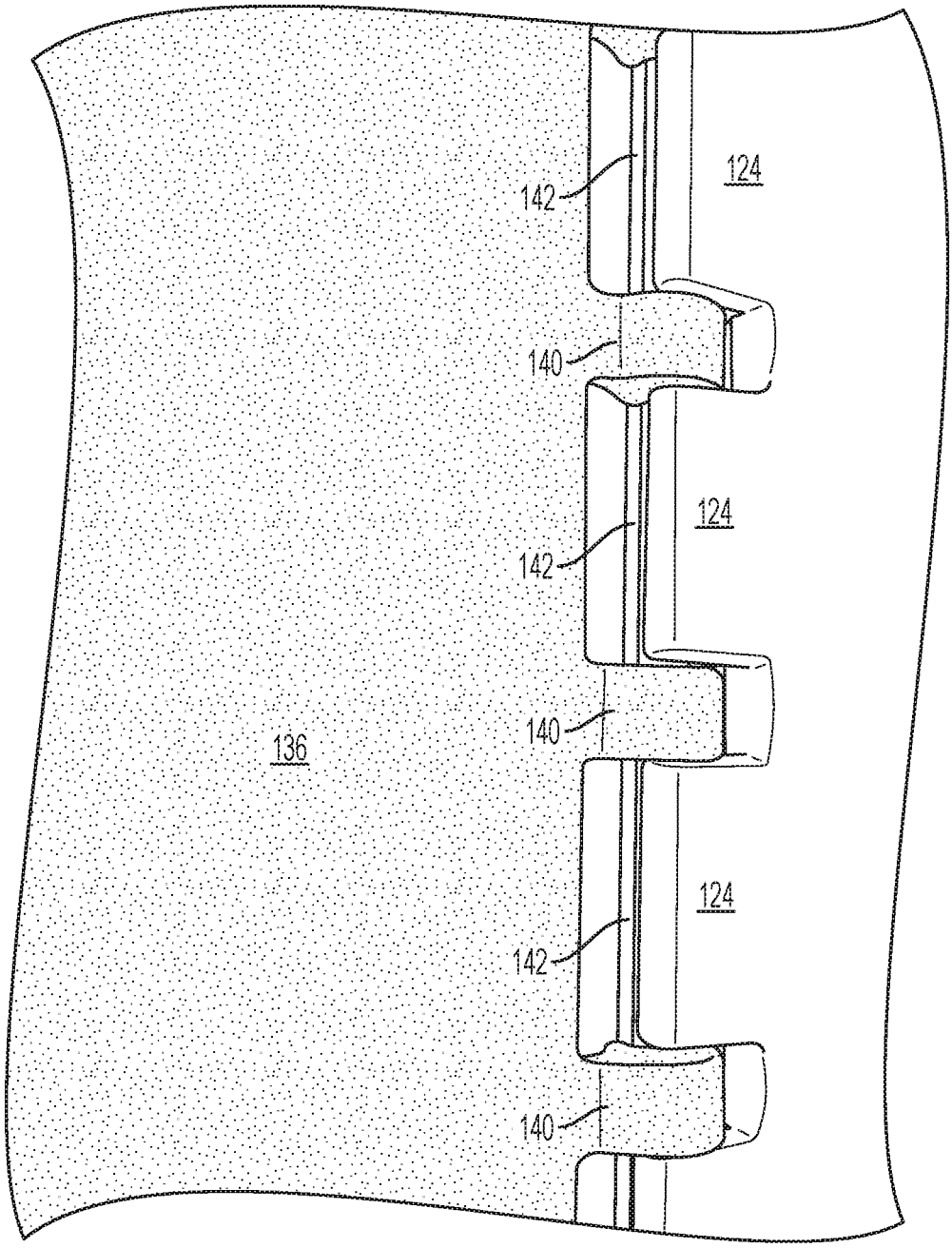
FIG. 9 depicts a portion of a hinge assembly according to one embodiment of the present invention.
Figure 10:
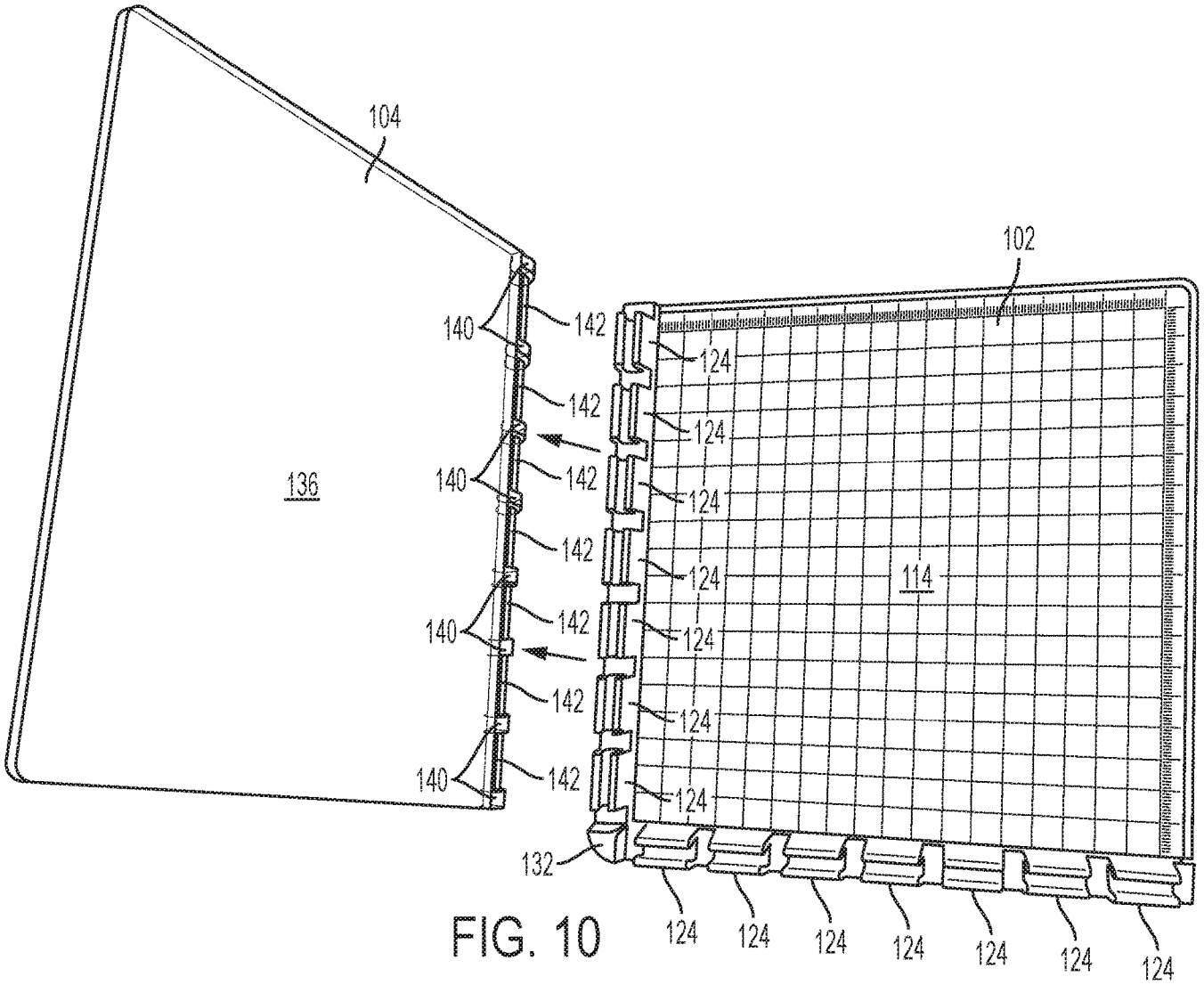
FIG. 10 depicts base and cover assembly according to one embodiment of the present invention.

Referring to FIGS. 3-4, 8-10, attachment of the cover 104 to the base 102 and the cover/base assembly are depicted. As best seen in FIGS. 8-10, a user would align hinge sections 124 with hinge bar 142 and receptacles 125 with protrusions 140. With the cover 104 at approximately a ninety-degree (90°) angle relative to the base 102, hinge bars 142 would be oriented such that the width of the hinge bars 142 is less than the width of the channels 126. Thus, the cover 104 can be directed downward until hinge bars 142 are in cavity 130. Protrusions 140 are also substantially seated in receptacles 125. As cover 104 is rotated in either an opening or closing direction, the relative orientation of hinge bars 142 to channels 126 changes such that the width of the hinge bars 142 becomes wider than the channels 126 effectively locking the cover 104 and preventing it from slipping off while in use. To remove the cover 104, essentially the reverse process is followed—namely, a user would orient the cover 104 at approximately a ninety-degree (90°) angle relative to the base 102 and gently pull up. Because the width of the hinge bars 142 in this orientation is less than the width of the channels 126, the cover 104 easily pulls off.

It is noted that the term hinge bars 142 is not intended to be limited to a rectangular cross-sectional shape. Provided there is an unequal cross-sectional aspect ratio such that the width of the hinge bars 142 is less than the width of the channels 126 in one orientation, but greater than the width of the channels 126 as the cover 104 is rotated, such shapes are considered to be within the scope of the present invention. For example, in addition to rectangular cross-sectional shape, the hinge bars 142 could have an oval, diamond, rounded diamond, as well as numerous polygonal cross-sectional shapes and combinations of the same.

It is noted that the attachment and removal of cover 104 will be the same whether the cover 104 is being secured to the base top hinge 106 or the base side hinge 108. However, it is not necessary that the base hinging mechanisms be identical in both the top and side. For example, in certain embodiments, it may be desirable to have longer hinge sections 124, as discussed previously herein, on the top hinge mechanism while having shorter hinge sections 124 on the side hinge mechanism. Provided the elements of the cover hinge properly align in both configurations, any combination of the embodiments discussed above are considered within the scope of the present invention.

To illustrate certain features of the present invention in its various embodiments, the following method of operation is provided. It is not however intended to capture all embodiments of the present invention nor is it intended to limit the scope of the claims to any particular embodiment.

Figure 11:
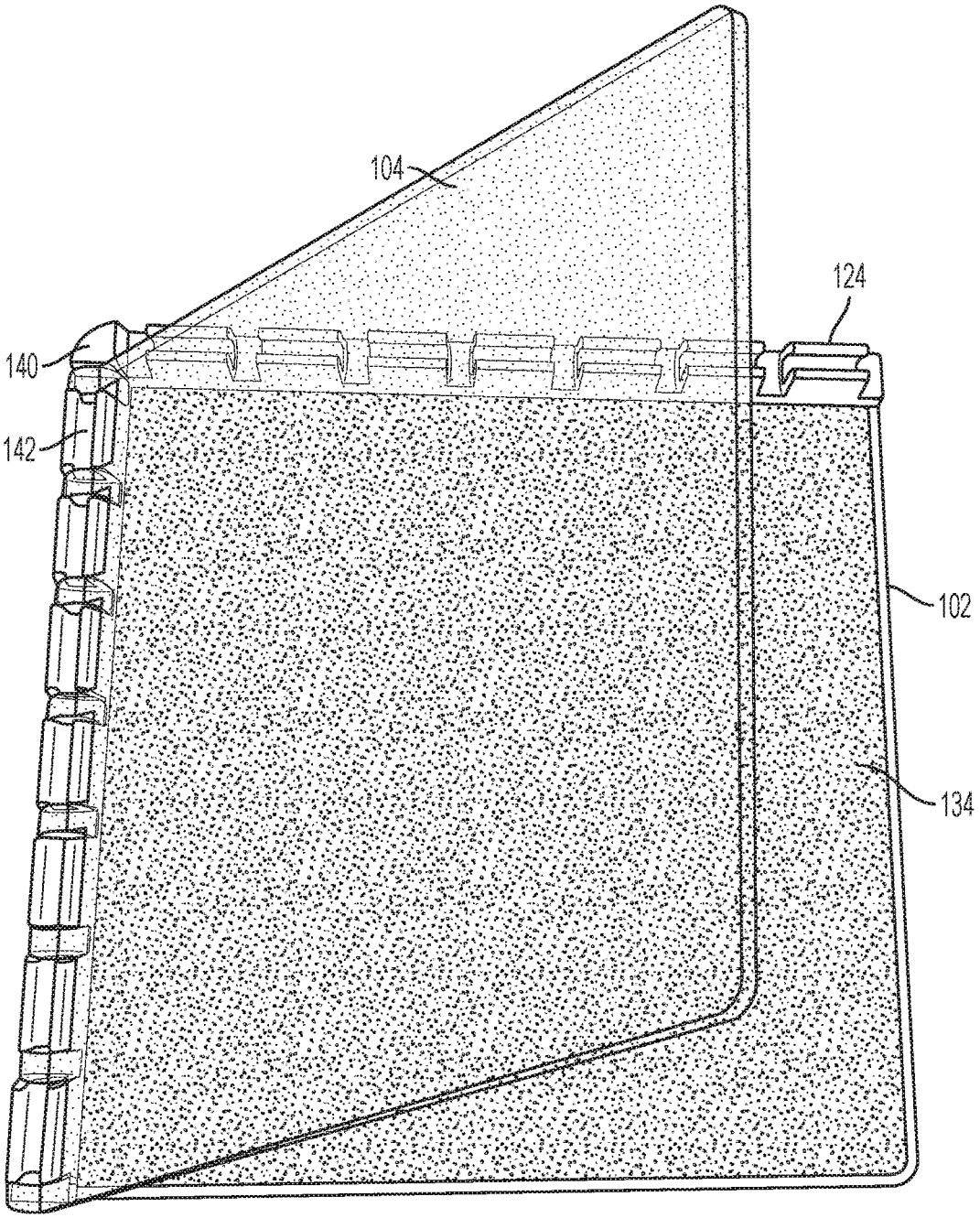
FIG. 11 depicts a craft stamping tool with an insert according to one embodiment of the present invention.

In operation, a user would typically lift the cover 104 of the craft stamping tool 100 and place a stamp on the top surface 114 of the base 102. Numerous types of stamps could be used in combination with the present stamping tool 100 including but not limited to photopolymer, red rubber and foam. The stamp would need some form of adhesive on its back surface (i.e. the surface opposite the surface resting on the base). Thus, as the cover 104 is closed, it presses down on the stamp and the stamp adheres to it. This allows for precision placement of the stamp, however in other circumstances a user could simply apply the stamp to the cover 104 by hand. In certain embodiments, thinner types of stamps will be used. In such embodiments, a shim such as a pad or insert 134 (FIG. 11) can be included to make up the additional space between the top surface 114 of base 102 and the underside of cover 104. In FIG. 11, the insert 134 is shown covering the entire surface of the base 102. In other embodiments, the insert 134 could be smaller or larger relative to the base 102. The insert 134 can be made of a variety of materials including but not limited to foam, rubber, plastic, wood, cloth or combinations of the same. It is also noted that since the cover 104 need not rest upon top hinge 106 and side hinge 108 in operation, shimming is often not required even for thinner stamps.

Whether working with or without the insert 134, a user can then secure the item to be stamped to the top surface 114 of the base 102. In one embodiment, the base 102 includes a ferromagnetic substance that allows a user to secure the item being stamped to it with one or more magnets. In other embodiments, the item to be stamped could be secured with a variety of other known mechanisms including but not limited to clips and weak adhesives or combinations of the same. In yet other embodiments, the base 102 itself could be magnetized and ferromagnetic materials could be placed on the item to be stamped to secure it in place. In any case, it is preferable that the item to be stamped be secured to the top surface 114 of the base 102 by some mechanism while in operation.

Grid lines 116 on base 102 and grid lines 138 on cover 104 allow precision placement of both the item to be stamped and the stamp itself. Thus the stamping tool 100 allows for precision and repetition.

Once the item to be stamped is secured, ink can be applied to the stamp that is adhered to cover 104. Ink can be applied in a variety of known ways. For example, a user could simply rub an inkpad over the stamp by hand or it could be applied by brush or cloth. Once the stamp is inked, the user would then close the cover 104 along rotational axis depicted at 112 in FIG. 4. The inked stamp will then contact the surface to be stamped applying the ink precisely where wanted. The cover 104 is then lifted and the stamped item can then be removed and replaced with a different item to be stamped or it can be reoriented and stamped again—allowing for a wide variety of patterns.

Notably, having the cover 104 capable of being easily removed from one base hinge (e.g. the base top hinge 106) and coupled with the other base hinge (e.g. the base side hinge 108) allows even greater flexibility in the types of patterns and designs that can be created. Having only two base walls 120, 122 also allows for items that are larger than the base 102 to be stamped.

Variations

In the illustrated embodiment, the shape of base 102 and cover 104 is substantially square. However, in other embodiments, the base 102 and cover 104 could be other rectangular shapes. In yet other embodiments, different polygonal shaped bases and covers with hinges on their edges could be utilized to create many different design configurations. However, rectangular is advantageous in that it allows wide variety in terms of the size and shape of the article to be stamped.

The stamping tool 100 can be made of various materials including, but not limited to plastic, acrylic, rubber, glass, wood, metal and combinations thereof.

In yet other embodiments, the relative positioning of the hinge sections 124 and hinge bars 142/protrusions 140 could be reversed—namely, the cover 104 could one or more hinge sections 124 on one edge and the base 102 could include the hinge bars 142 and protrusions 140 along its top and side edges.

Numerous other modifications and alternative arrangements may be devised by those skilled in the art without departing from the spirit and scope of the present invention.

What is claimed is:

1. A stamping tool comprising:

a) a base having i) a first base hinge; and ii) a second base hinge substantially perpendicular to the first base hinge; and wherein the first and second base hinges further comprise one or more hinge sections having a first wall and a second wall; wherein the first wall and the second wall are biased to define a cavity accessible through a channel between the first wall and the second wall; and wherein the one or more hinge sections are separated by one or more receptacles; and b) a cover removably attachable to the base, wherein the cover includes:

i) one or more hinge bars corresponding to the one or more hinge sections and wherein the one or more hinge bars have an unequal aspect ratio; and ii) one or more protrusions separating the one or more hinge bars and corresponding to the one or more receptacles.

2. The stamping tool of claim 1, wherein the one or more hinge bars are rectangular shaped in cross section.

3. The stamping tool of claim 1, wherein the one or more hinge bars are oval shaped in cross section.

4. The stamping tool of claim 1, wherein the one or more hinge bars are diamond-shaped in cross section.

5. The stamping tool of claim 1, wherein the one or more protrusions are rounded.

6. The stamping tool of claim 1, wherein the one or more receptacles are rounded.

7. A stamping tool comprising:

a) a base having i) a first base hinge; and ii) a second base hinge substantially perpendicular to the first base hinge; and wherein the first and second base hinges further comprise one or more hinge sections having a first wall and a second wall; wherein the first wall and the second wall define a cavity accessible through a channel between the first wall and the second wall; and b) a cover removably attachable to the base, wherein the cover includes:

i) one or more hinge bars corresponding to the one or more hinge sections and wherein the one or more hinge bars have an unequal aspect ratio.

8. The stamping tool of claim 7, wherein the one or more hinge sections are separated by one or more receptacles.

9. The stamping tool of claim 8, wherein the one or more hinge bars are separated by one or more protrusions corresponding to the one or more receptacles.

10. The stamping tool of claim 7, wherein the first wall and the second wall are biased toward each other.

11. The stamping tool of claim 7, wherein the one or more hinge bars are rectangular shaped in cross section.

12. The stamping tool of claim 7, wherein the one or more hinge bars are oval shaped in cross section.

13. The stamping tool of claim 7, wherein the one or more hinge bars are diamond-shaped in cross section.

14. The stamping tool of claim 7, wherein the one or more protrusions are rounded.

15. The stamping tool of claim 7, wherein the one or more receptacles are rounded.

16. A method for stamping an article comprising the steps of:

a) providing a stamping tool comprising:

i) a base having a top surface, a first base hinge and a second base hinge substantially perpendicular to the first base hinge and wherein the first and second base hinges further comprise one or more hinge sections; and ii) a cover removably attachable to the base, wherein the cover has a bottom surface relative to the base and includes one or more hinge bars corresponding to the one or more hinge sections and wherein the one or more hinge bars have an unequal aspect ratio;

b) placing the cover in an open position relative to the base;

c) adhering a stamp to the bottom surface of the cover;

d) placing the article on the top surface of the base;

e) applying a quantity of ink to the stamp;

f) placing the cover in a closed position relative to the base whereby the stamp is brought into contact with the article thereby stamping the article with the quantity of ink.

17. The method of claim 16, wherein the hinge sections have a first wall and a second wall wherein the first wall and the second wall define a cavity accessible through a channel between the first wall and the second wall.

18. The method of claim 17, wherein the first wall and the second wall are biased toward each other.

19. The method of claim 16, wherein the stamp is a photopolymer stamp.

20. The method of claim 16, wherein the stamp is a red rubber stamp.

* * * * *